United States Patent [19]

Corder et al.

[11] Patent Number: 4,854,143

[45] Date of Patent: Aug. 8, 1989

[54] BOLT ASSEMBLY AND METHOD

[75] Inventors: Thomas E. Corder, Danville; John F. Stewart, San Jose, both of Calif.

[73] Assignee: Intelock Corporation, Pleasanton, Calif.

[21] Appl. No.: 83,621

[22] Filed: Aug. 7, 1987

[51] Int. Cl.[4] ..... E05B 13/10

[52] U.S. Cl. ..... 70/218; 70/223; 70/279; 70/422; 192/84 R; 340/825.31

[58] Field of Search ..... 70/277-279, 70/283, 472, 218, 222, 223, 422, 107; 292/144, 201, DIG. 27; 361/171, 172; 340/825.31, 825.34, 825.36; 192/84 R

[56] References Cited

U.S. PATENT DOCUMENTS

| | | | |
|---|---|---|---|
| 1,516,152 | 11/1924 | Dumont | 70/422 |
| 3,894,417 | 7/1975 | Taniyama | 70/277 X |
| 3,939,679 | 2/1976 | Barker et al. | 70/277 |
| 3,947,060 | 3/1976 | Zimmer et al. | 70/279 X |
| 4,073,518 | 2/1978 | Goodwin | 70/222 X |
| 4,073,527 | 2/1978 | Schlage | 292/DIG. 27 X |
| 4,177,657 | 12/1979 | Aydin | 70/223 X |
| 4,286,305 | 8/1981 | Pilat et al. | 70/279 X |
| 4,457,148 | 7/1984 | Johansson et al. | 70/278 |
| 4,656,850 | 4/1987 | Tabata | 70/283 X |
| 4,671,087 | 6/1987 | Olenfalk et al. | 70/283 |
| 4,762,212 | 8/1988 | Fish et al. | 70/283 X |

FOREIGN PATENT DOCUMENTS

| | | | |
|---|---|---|---|
| 355578 | 6/1922 | Fed. Rep. of Germany | 70/218 |
| 2169649 | 7/1986 | United Kingdom | 70/278 |

*Primary Examiner*—Lloyd A. Gall

*Attorney, Agent, or Firm*—Flehr, Hohbach, Test, Albritton & Herbert

[57] ABSTRACT

A bolt assembly (21) including a movable bolt (34) and a user manipulatable bolt displacement assembly is disclosed. The bolt displacement assembly moves the bolt (34) between a locked and an unlocked position. The bolt displacement assembly includes a user manipulated handle (37), a torque transfer assembly (b 38) and an electromagnet (39). Handle (37) is mounted on an exterior side (36) of the bolt assembly (21) and is freely movable without coupling of the handle (37) to displace the bolt (34). Torque transfer assembly (38) in the form of a rocker arm (63) is mounted for movement in response to movement of the handle (37) and moves to and from a torque transmitting position during at least part of the movement cycle of the handle (37). Additionally, electromagnet (39) is reponsive to user input for energization thereof and is positioned to magnetically hold the torque transfer assembly (38) in the torque's transmitting position upon the simultaneous occurrence of energization of the electromagnet (39) and movement of the torque transfer assembly (38) to the torque transmitting position by the handle (37). Handle (37) is further movable by the user while the torque transfer assembly (38) is held in the torque's transmitting position to couple the handle (37) to bolt (34) to move the bolt (34) between the locked position and the unlocked position. Additionally, an optic link (29, 32) coupling dead bolt assembly (21) to an electronic door lock assembly (23) is provided so that input to the door lock assembly (23) automatically energizes the electromagnet (39) in the dead bolt assembly (21) to permit opening of the dead bolt assembly (21).

23 Claims, 7 Drawing Sheets

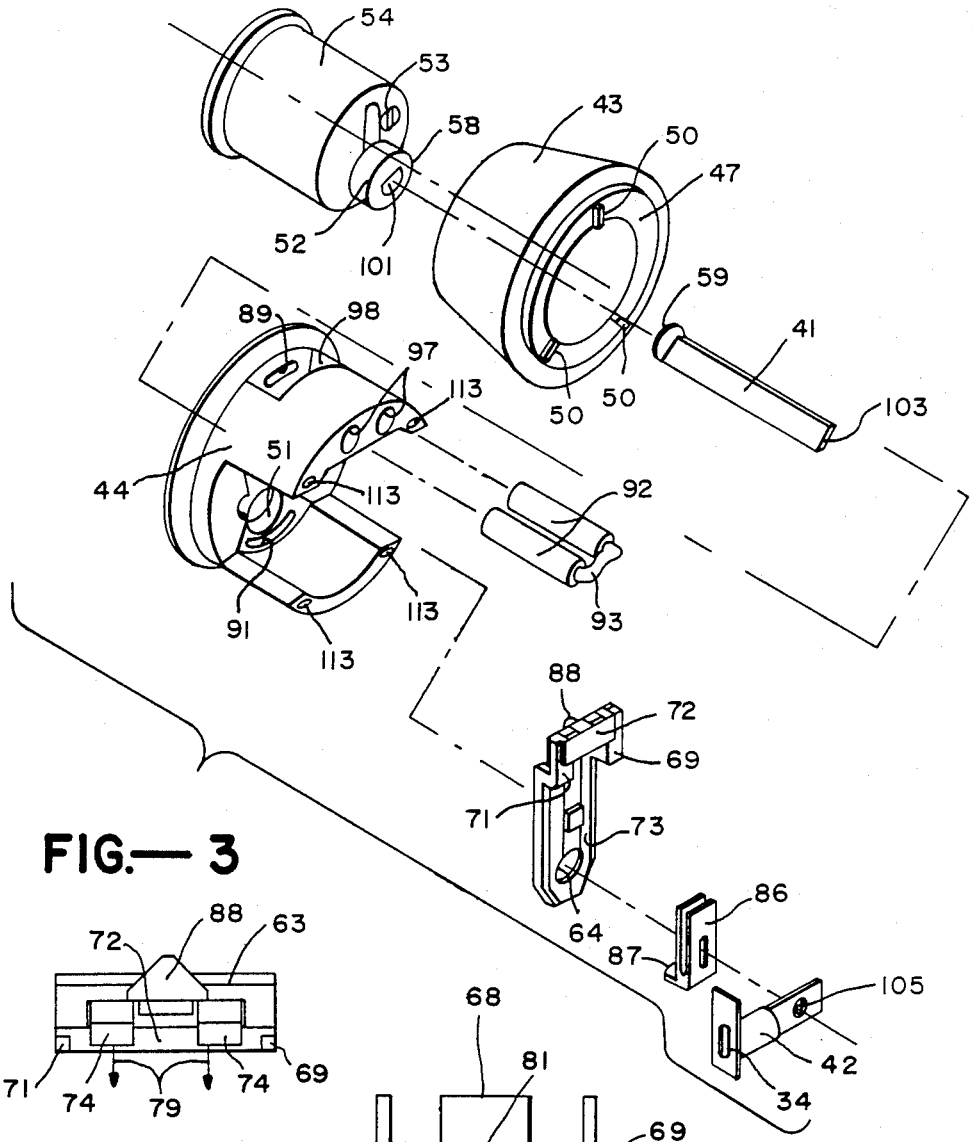
FIG.— 3
FIG.—10
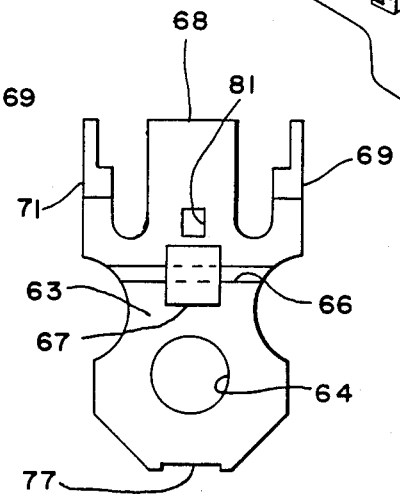
FIG.— 11

BOLT ASSEMBLY AND METHOD

TECHNICAL FIELD

The present invention relates, in general, to the field of electrically powered lock assemblies, and more particularly relates to battery-powered, keyless, dead bolt assemblies.

BACKGROUND ART

In recent years there has been considerable interest and effort in connection with the development of electrically powered locks. Such locks often are designed so that they eliminate the need for the use of keys, which can be lost, stolen or copied. Keyless, electrically-powered locks provide the user with considerable convenience in their operation, as well as the required security. They also eliminate the need to replace or re-key the lock in the event of loss or unauthorized copying of the key.

Typical of a battery-powered, keyless lock assembly is the lock disclosed in U.S. Pat. No. 4,457,148 to Johansson, et al. This lock assembly employs an electromagnet which is energized upon receipt of a digital input signal having a predetermined combination. The input signal is preferably generated by manipulation of the door handle, and the manipulation of the door handle is employed to close the air gap between the solenoid and armature of the electromagnet, as well as move the bolt.

While there are numerous examples of electronic door locks which have been employed as conventional spring-biased lock sets, little has been developed in the area of electrically powered dead bolt assemblies. In a dead bolt assembly the bolt is moved positively between the locked and unlocked positions by a handle or by a key without the action of a spring or biasing means. The throw of the bolt in a dead lock assembly is usually greater than that of a spring-biased door lock, and preferably the bolt is locked or blocked against movement away from the locked position by a latching bar or lever mechanism.

Thus, even when electrically powered door locks are installed, a conventional keyed dead bolt is usually provided for additional security and strength in connection with locking of the door. Since the purpose of a dead bolt assembly is to provide additional strength, it is essential that the dead bolt assembly be constructed in a manner which does not enable an unauthorized entry by simply mechanically forcing the dead bolt assembly. Thus, dead bolt assemblies must not be constructed in a manner which will allow a burglar or vandal to obtain "purchase" or a torque applying configuration that can be used to defeat the dead bolt. Typically, spring-biased door lock assemblies are subject to override by burglars who use a pipe wrench or the like to grip the door handle and force the lock. While a conventional door lock assembly can be subject to such unauthorized entry, the purpose of having a dead bolt assembly is to maintain the door in a locked condition even when the conventional spring-biased door lock is forced open.

The requirements for a relatively long throw on the bolt of a dead bolt lock and purchase-free construction of the dead bolt assembly make electrical powering of dead bolt assemblies difficult. If a dead bolt assembly is constructed in a manner which employs electrical power to move the bolt over the long distance of a throw, it is virtually an absolute requirement that the dead bolt assembly be electrically connected to the power in the home. Thus, a battery-powered system is not suitable for a dead bolt assembly in which movement of the bolt is electrically powered. While theoretically possible, electrical connection of a dead bolt assembly to the home or office power presents substantial practical installation problems and costs.

In the electronic digital combination lock of the Johansson U.S. Pat. No. 4,457,148, a battery-powered lock is provided in which the user is able to manipulate the door handle so as to input a signal energizing the electromagnet, close the gap between the armature and solenoid of the electromagnet, and displace the bolt. Thus, the mechanical power or torque required to move the bolt and to close the electromagnet for operation is provided by the user through a handle on the exterior of the door assembly. This approach, however, provides unique problems when applied to a dead bolt assembly. It is essential, as above-noted, that the dead bolt assembly not be constructed in a manner which will allow a handle to be forced by a tool from the exterior of the door. Dead bolts typically do not include exterior handles which would enable a pipe wrench to be applied to force the lock.

Accordingly, it is an object of the present invention to provide a keyless dead bolt assembly which is electrically powered by batteries and yet is easy to use and provides the security of a conventional dead bolt.

Another object of the present invention is to provide an electrically powered, keyless, dead bolt assembly which is relatively inexpensive to construct, durable and requires minimum power to operate.

Still a further object of the present invention is to provide an electrically powered, keyless, dead bolt assembly which can be retrofitted into a wide range of installations.

Another object of the present invention is to provide a battery-powered bolt assembly and method of operation of the same in which the mechanical movement of components is effected by user manipulation of a handle in order to minimize the consumption of electrical power and yet the handle cannot be mechanically forced.

Still a further object of the present invention is to provide a dead bolt assembly which can be used with and opened by entry of a combination into an adjacent electronic door lock assembly.

Another object of the present invention is to provide an electrically powered dead bolt assembly which can be easily locked by the user without a coded input.

Still an additional object of the present invention is to provide a keyless dead bolt assembly which can be adapted for coded input as a stand-alone lock or operated as a slaved assembly in connection with another door lock assembly.

Another object of the present invention is to provide an electrically powered dead bolt assembly which is suitable for use in right-handed and left-handed dead bolt installations.

The dead bolt assembly and method of the present invention have other objects and features of advantage which will become apparent from or are set forth in more detail in the accompanying drawings and following description of the Best Mode Of Carrying Out The Invention.

DISCLOSURE OF THE INVENTION

The bolt assembly of the present invention includes a movable bolt and a user manipulatable bolt displacement assembly for displacement of the bolt between a locked position and an unlocked position. The improvement in the bolt assembly comprises, briefly, the displacement assembly including a user manipulatable handle on an exterior side of the bolt assembly mounted for movement without coupling of the handle to displace the bolt, and the displacement assembly further including torque transfer assembly mounted for movement in response to movement of the handle to and from a torque transmitting position during at least a part of the movement cycle of the handle. The displacement assembly also includes an electromagnet having an input for energization and positioned to magnetically hold the torque transfer assembly in the torque transmitting position upon the simultaneous occurrence of energization of the electromagnet and movement of the torque transfer assembly to the torque transmitting position. The handle is further movable by the user while the torque transfer assembly is in torque transmitting position to couple the handle to the bolt for the transmission of torque from the handle through the torque transfer assembly to move the bolt from the locked position to the unlocked position.

In another aspect of the present invention a combination of a spring-biased door lock assembly and a springless, dead bolt assembly mounted proximate to the door lock assembly is provided with means coupling the operation of an electromagnet in the dead bolt assembly to the operation of an electromagnet in the door lock assembly for energization of both electromagnets upon receipt of a coded input into one of the lock assemblies.

In a further aspect of the present invention a method of operating a bolt assembly having a freely movable exterior handle and torque assembly for transmitting the movement of the handle to the bolt is provided which includes the steps of coupling the torque assembly to the handle by moving the handle through a movement cycle including a torque transmitting position and inputting an electromagnet in the bolt assembly to energize the magnet and hold the torque transfer assembly in the transmitting position, and thereafter moving the handle while the torque transfer assembly is coupled to the handle until movement of the handle produces movement of the bolt.

BRIEF DESCRIPTION OF THE DRAWING

FIG. 3 is a perspective, exploded view of the exterior side components of the dead bolt assembly of FIG. 2.

FIG. 10 is a top plan view of the rocker assembly of FIG. 9.

FIG. 11 is an end elevation view of one side of the rocker arm without the spring or armature.

BEST MODE OF CARRYING OUT THE INVENTION

The bolt assembly of the present invention is most preferably constructed for use in association with a door lock assembly to provide an electronic dead bolt which can be unlocked after unlocking of the basic door bolt assembly. The bolt assembly of the present invention, however, can be employed as a stand-alone dead bolt, and it can be used with bolts which are spring biased to a latched position.

Figure 1:
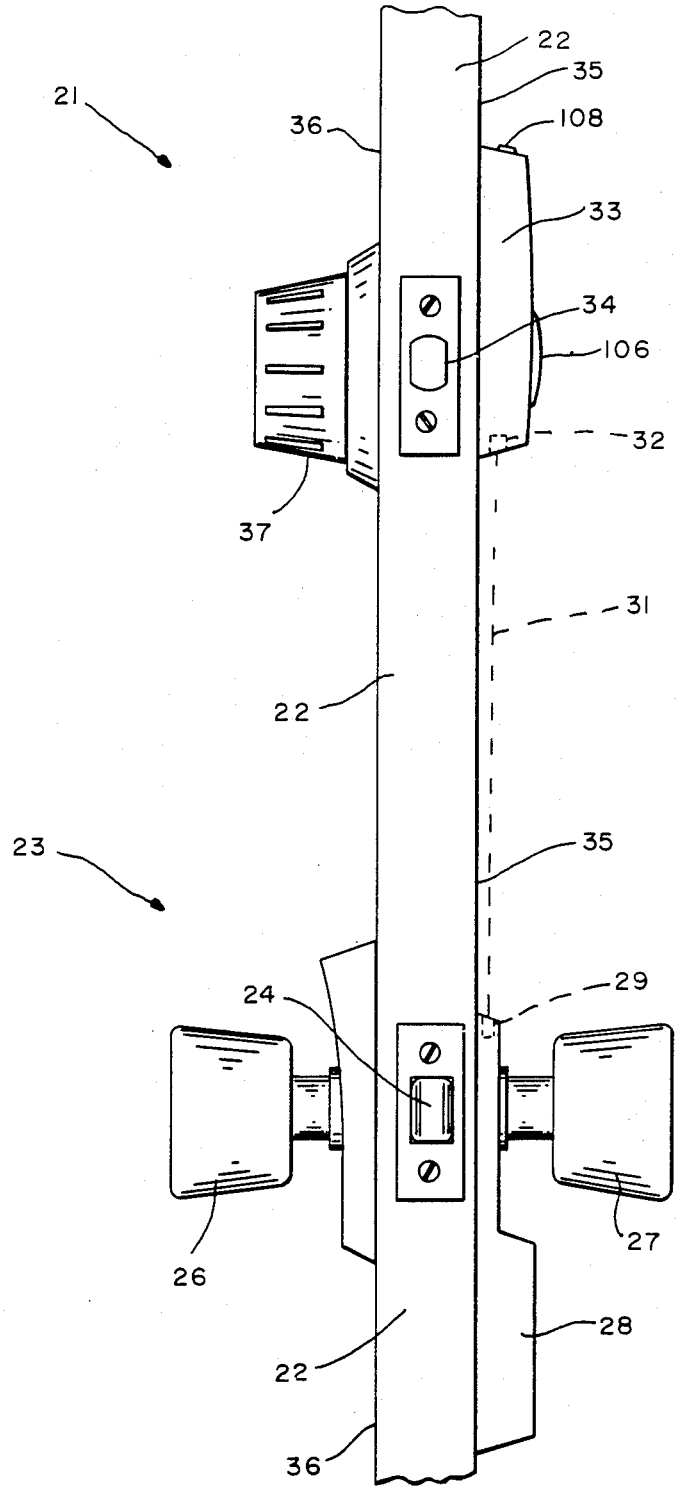
FIG. 1 is a side elevation view of a dead bolt assembly and a door lock assembly shown installed together on a door or similar structure.
Figure 8:
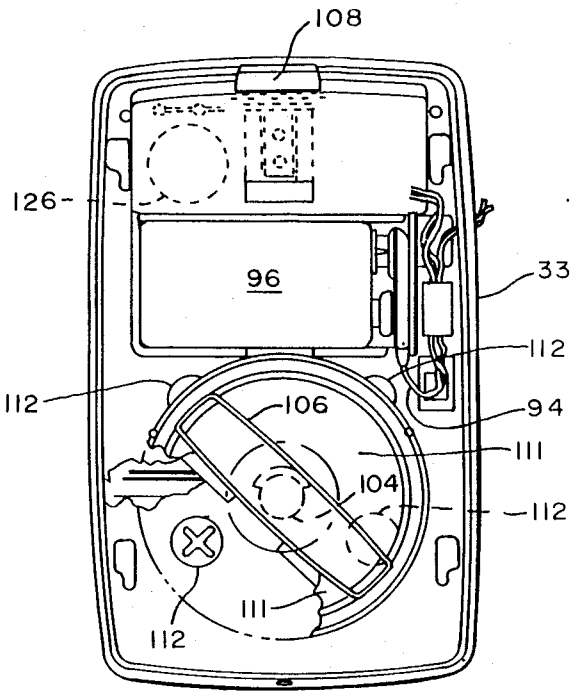
FIG. 8 is an end elevation view of the interior components of the dead bolt assembly shown in FIG. 2.

The preferred installation of the bolt assembly of the present invention is shown in FIG. 1. An electrically powered dead bolt assembly, generally designated 21, is mounted to a door or similar partition 22, and mounted below bolt assembly 21 is an electrically powered door lock assembly, generally designated 23. Door lock assembly 23 advantageously may be of the same general type as the electronic digital combination door lock assembly disclosed in U.S. Pat. No. 4,457,148 to Johansson, et al. Thus, door lock set 23 preferably includes a movable bolt 24, a pair of movable handles 26 and 27, spring biasing means (not shown) biasing bolt 24 toward a locked position, and a lock assembly (not shown) for locking the bolt in and releasing the bolt for movement from the locked position. Electromagnet means responsive to user input for enabling handle means 26 to unlock and move door bolt 24 against the biasing spring is also provided in lock assembly 23.

In the most preferred form, door lock assembly 23 is constructed to provide for user input to energize the electromagnet enabling unlocking and movement of bolt 24 by receiving a coded digital input from the user of the door lock. One approach to such a coded digital input is to provide switch means (not shown) as disclosed in U.S. Pat. No. 4,457,148, which can be actuated by manipulation of handle 26. Thus, a digital combination code can be input by rotating handle 26 to close and open switches which will generate a digital input that can be compared to a stored code and used to energize the electromagnet when a match is achieved. Alternatively, input to lock assembly 23 for energizing the electromagnet can be from a key pad or a transmitter and receiver at lock assembly 23.

The details of construction of door lock assembly 23 will not be repeated herein since a suitable construction is set forth in U.S. Pat. No. 4,457,148. Door lock assembly 23, however, further includes an additional element not found in the referenced patent. Mounted to the inside control housing 28 of door lock assembly 23 is means 29 which is formed to transmit or receive a signal, as shown by dotted line 31. Signal 31 preferably is transmitted by a transmitter 29 to receiver means 32 provided on inside control housing 33 of dead bolt assembly 21. It is possible, however, to provide a transmitter at dead bolt assembly 21 and a receiver at door lock assembly 23. Thus, a transmitter and a receiver provide means coupling the energization of the electromagnets in door lock assembly 23 and dead bolt assembly 21.

In the preferred configuration, the electronics of door lock assembly 23 have been modified from that of U.S. Pat. No. 4,457,148 to the extent of providing a transmitter 29 which is triggered when the electromagnet in a door lock assembly is energized by input of the proper combination to the door lock assembly. Transmitter 29 sends an encoded signal 31 to receiver 32 in the dead bolt assembly, which in turn energizes the electromagnet in the dead bolt assembly. Further details of the coupling of the door lock assembly 23 and dead bolt assembly 21 for operation together will be set forth hereinafter.

In order to provide the security of a conventional dead bolt assembly, bolt assembly 21 preferably includes a movable bolt 34 and a user manipulatable bolt displacement assembly for positive displacement of bolt 34 between a locked position and an unlocked position without the action of a spring. Moreover, mounted on the exterior side 36 of door 22 is a user manipulatable handle means 37 which is freely movable without coupling to move bolt 34. Thus, handle means 37 can be rotated freely in either direction without moving bolt 34. An intruder applying a pipe wrench or the like to handle 37 will be unable to communicate torque through the handle to bolt 34.

The user manipulatable bolt displacement assembly of dead bolt 21 broadly includes handle means 37, torque transfer means 38, electromagnet means 39, drive bar 41 and bolt assembly 42. Such bolt displacement means is formed for free rotation of handle means 37 until torque transfer means 38 is coupled by electromagnet means 39 to handle 37 so that torque forces applied to the handle can be transmitted through the torque transfer means 38 to drive bar 41 and bolt assembly 42.

Handle Means

Handle means 37 is comprised of a movable member 43 which is rotatably mounted to stationary lock body member 44. The lock body member 44 is formed with an annular groove 46 in an outwardly facing end thereof. Extending into groove 46 is an annular inwardly facing surface 47 on the end face of handle member 43. Bearing means 48 can be provided for support of member 43 for rotation with respect to stationary lock body 44. A central portion 49 of lock body 44 is formed with an opening 51 therethrough to receive bolt drive bar 41.

In order to permit opening of bolt assembly 21 with a mechanical key, it is further preferable that a key actuated tumbler assembly 52 be mounted, for example, by fastener 53, to a central stationary member 54 positioned in a bore 56 in handle member 43. Again, it is advantageous to provide bearing means 57 between members 43 and 54 so that handle member 43 is free to rotate with respect to member 54 containing mechanical lock 52. An inner end 58 of mechanical lock 52 receives the end 59 of bolt drive bar 41, and end 58 of the mechanical key lock is inserted into bore 51 of the central portion 49 of stationary lock body 44. As will be seen, bore 51 is located in displaced relation with respect to the axis of rotation of handle 43 so that insertion of end 58 of mechanical lock 52 into bore 51 will secure the mechanical lock, and central member 54 in which it is mounted, against rotation.

Handle means 37, therefore, as thus far described, is free to rotate about central body 54 and to rotate in annular groove 46 in lock body 44. It is further preferable that member 43 of the handle and body 44 be covered with a covering sheet 61 to provide the desired decorative appearance and to provide manually engageable ribs 62 which facilitate handle manipulation. Obviously, decorative features and ribs also can be formed directly in body 43 if desired.

In order to facilitate torque transfer from handle means 37 to the torque transfer means 38, it is preferable that handle member 43 include at least one, and most preferably a plurality of lugs or protrusions 50 (FIG. 3) which extend in an inward direction from annular face 47 of the handle. Thus, in the preferred form three protrusions 50 are substantially equally circumferentially spaced about annular surface 47 so as to cooperate with torque transfer assembly 38 in a manner which will be more fully described hereinafter.

Torque Transfer Assembly

In order to enable selective coupling of handle means 37 to move bolt 34, lock assembly 21 includes a torque transfer means or assembly 38. In the preferred form, torque transfer means 38 is provided by a rocker arm 63 which is pivotally mounted by pivot pin 64 for a rocking motion toward and away from handle means 37. Thus, the axis of rotation of handle means 37 and the axis of pivoting of rocker arm 63 about pivot pin 64 are in planes which are substantially perpendicular to each other.

Torque transfer assembly 38 can be seen in further detail in FIGS. 9 through 13. The main rocker body 63 is formed with a central opening 65 dimensioned to rotatably receive drive bar 41 therethrough. A groove 66 is provided on an inwardly facing side of body 63 to rotatably receive pivot pin 64. The pivot pin is trapped in groove 66 by body portion 67 which extends across groove 66.

The upper or first end 68 of the rocker assembly is formed with a pair of upwardly and inwardly projecting arms 69 and 71. Mounted between arms 69 and 71 is a ferromagnetic member 72 which acts as an armature for electromagnet means 39 in a manner which will be more fully described hereinafter.

Figure 13:
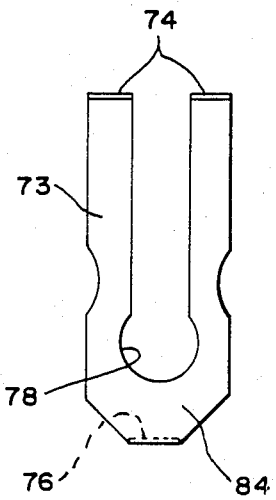
FIG. 13 is an end elevation view of a retainer spring employed in the rocker assembly of FIG. 9.

Armature 72 is retained in rocker assembly 38 by a U-shaped leaf spring member 73 shown in FIG. 13. The upper ends 74 of leaf spring 73 extend transversely over the top of the armature while a lower, outwardly projecting tab 76 is received in a notch 77 in the bottom end of rocker body 63. The leaf spring has a central passageway or opening 78 which is also dimensioned to rotatably receive bolt drive bar 41 therethrough. Leaf spring 73 applies a force biasing armature 72 outwardly, as indicated by arrows 79, against arms 69 and 71. The entire leaf spring assembly is maintained at its lower end 84 in contact with body 63 of the rocker arm assembly by a U-shaped clip 86.

Additionally, body 63 of the rocker arm is formed with an opening 81 dimensioned to receive an alignment pin 82 (FIGS. 4 through 6) mounted to the central portion 49 of lock body 44. The ends of pivot pin 64 are mounted to central portion 49 of the lock body by a pair of fasteners 83 (FIG. 7) which extend over groove 66 and secure rocker assembly 63 for pivoting about pin 64.

The lower end 84 of spring 73 is secured to the lower or second end of rocker arm body 63 by a U-shaped clip or member 86 shown in FIGS. 3 through 7. Clip 86 functions to insure that a biasing force in the direction of arrows 79 is applied by spring 73 to armature 72, and it further provides a tab or projection 87 which extends in the direction of handle means 37 from rocker assembly 38.

Also extending in the direction of handle means 37 from torque transfer assembly 38 is a projection 88 from first end 68 of the assembly. The rocker arm assembly is dimensioned so that projection 88 extends into an opening 89 (FIGS. 3 and 6) in lock body 44 while projection 87 extends into a similar opening 91 (FIGS. 3 and 5) in the lower end of body 44. Openings 89 and 91 communicate with upper and lower portions of annular groove 46 into which annular face 47 of handle member 43 also extends.

Figure 4:
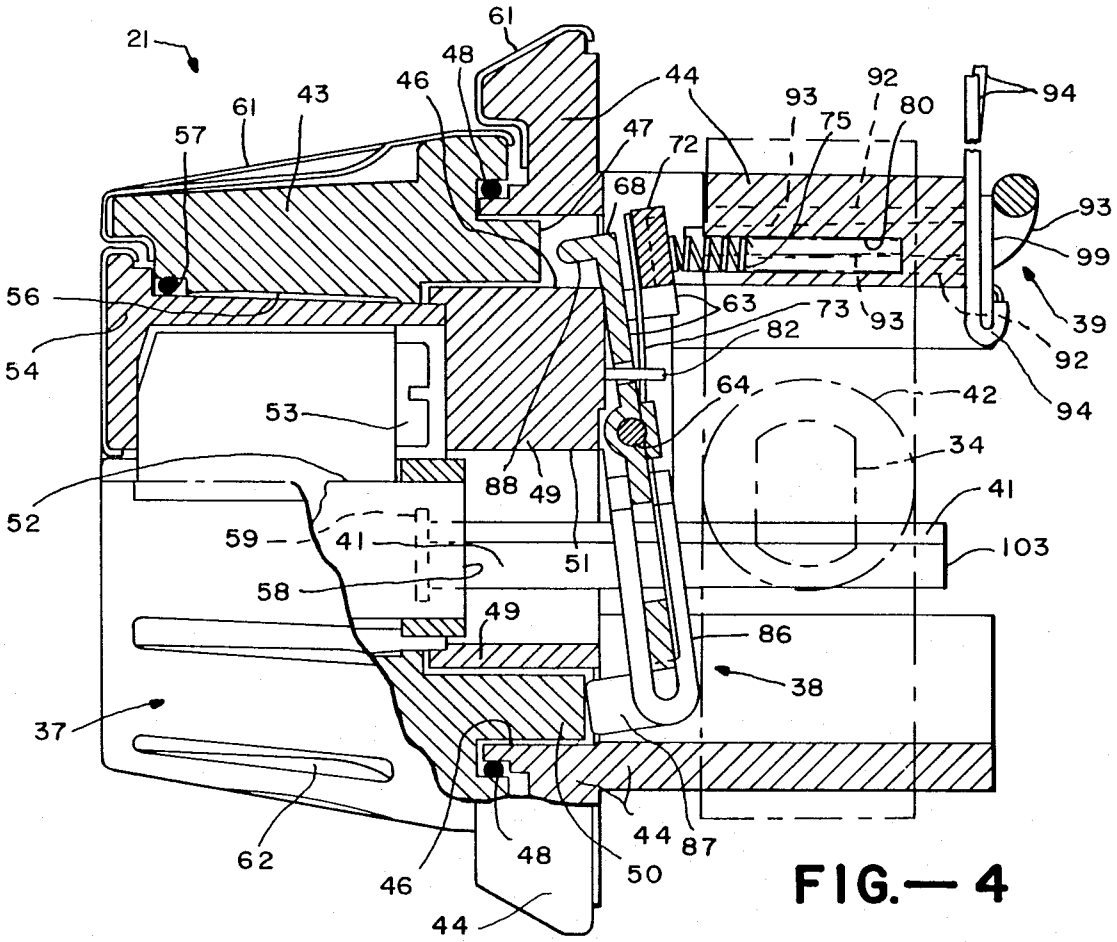
FIG. 4 is an enlarged, side elevation view, partially broken away and a cross section, of the exterior components of the dead bolt assembly of FIG. 2, with the handle shown uncoupled from the bolt drive bar.

Finally, a spring 75 is mounted in bore 80 in lock body 44 so as to bias rocker arm assembly 38 to the position shown in FIG. 4. Thus, spring 75 bears upon armature 72 and urges the armature and rocker assembly 38 toward handle means 37.

Electromagnet Means

Figure 2:
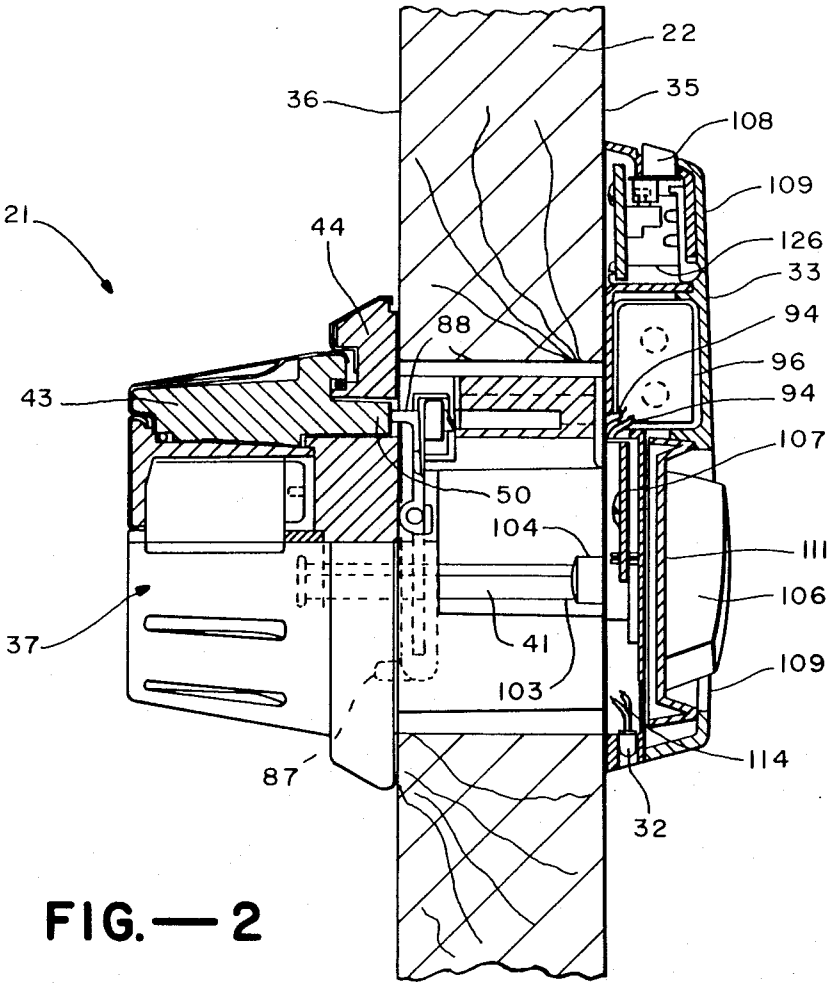
FIG. 2 is an enlarged, side elevation view, in cross-section of a dead bolt assembly constructed in accordance with the present invention.

Latching or securement of torque transmitting assembly 38 in a position coupling the same to handle means 37 is accomplished by electromagnetic means 39. Electromagnetic means 39 includes armature 72 mounted to rocker arm assembly 38 and a solenoid assembly comprised of coils 92 positioned around U-shaped ferromagnetic core member 93. Electrically conductive lines 94 connect coils 92 electrically to battery 96 (FIG. 2) in control housing 33. The electromagnet core and coil assembly (herein collective referred to as the solenoid) are mounted in cylindrical bores 97 (FIG. 3) in lock body 44 with the ends of the cores extending out beyond the notch 98 which receives upper or first end 68 of rocker assembly 38. Thus, when rocker assembly is in the position of FIGS. 5 and 6, armature 72 will contact the ends of U-shaped solenoid core 92. The solenoid of the electromagnet is secured in the end of body 44 by a mounting plate 99.

An important feature of the electromagnet assembly of the present invention is that armature 72 is mounted to have "overtravel." Thus, rocker assembly 38 will pivot about pin 64 in an amount which always insures contact between the armature and the solenoid. Moreover, the rocker pivots beyond or overtravels the core with retainer spring 73 deflecting to allow the armature to move away from arms 69 and 71 when the armature contacts core 92 and the rocker continues to pivot. The amount of overtravel permitted by spring 73 is preferably about 0.030 to 0.040 inches.

One advantage of providing an overtravel feature is that it maximizes the magnetic coupling between the armature and solenoid by insuring positive contact of core 92 with the armature. Since electromagnet means 39 must have sufficient force to overcome the biasing force of spring 75, as is explained hereinafter, contact between the armature and solenoid core insures maximum magnetic coupling with minimum power use.

Drive Bar And Bolt Assembly

Drive bar 41 and bolt assembly 42 are of a conventional construction and do not constitute a novel portion of the lock of the present invention. Thus, drive bar 41 includes a disk 59 at an inner end thereof which can be mounted through D-shaped opening 101 in the inner end 58 of the mechanical key or tumbler assembly 52. Bar 41 extends outwardly therefrom and proceeds through slots 102 in each of the le clip 86, as well as through the round opening 65 in rocker member 63. Bolt assembly 42 similarly includes a slotted opening 105 (FIG. 3) dimensioned to receive bar 41, and the outer or distal end 103 of the bar is mounted in a slot (not shown) in the inner end of shaft 104 (FIG. 2) of thumb turn or knob 106. Bolt assembly 42 is conventional in every respect and typically includes bolt 34 which is driven by a lever system upon rotation of drive bar 41. The lever system most typically has an over-center construction so that when the bolt is fully extended a blocking member drops to a position preventing prying of the bolt to an open position by a force applied to bolt 34. The drive bar simultaneously releases the blocking member and displaces the bolt to the retracted position when the drive bar is rotated by about 90 degrees. Rotation of the drive bar by a key in tumbler assembly 52 or by thumb turn 106 will extend or retract bolt 34 independently of the novel bolt displacement apparatus of the present invention.

Control Housing

Mounted to interior side 35 of door 22 is control housing 33. As above-described, housing 33 has battery 96 mounted therein and thumb turn 106 mounted thereto. Also contained in control housing 33 is logic board 107 containing a timing oscillator and electronic logic circuitry. An exit button assembly 108 and annunciator 126 also are contained in housing 33. The exterior cover 109 of control housing 33 is removable to provide access to battery 96. Additionally, a cover plate 111 is frictionally mounted over thumb turn 106 and can be removed to provide access to four fasteners 112. Fasteners 112 extend into the openings 113 (FIG. 3) provided in the body 44 of lock assembly 21. Thus, fasteners 112 secure the inner and outer lock assembly components together as a unit on door 22.

As also set forth below, control housing 33 contains coupling means 32, preferably a receiver, with its electrical connections 114 that are coupled to circuit board 107 and the logic contained therein.

OPERATION

Figure 5:
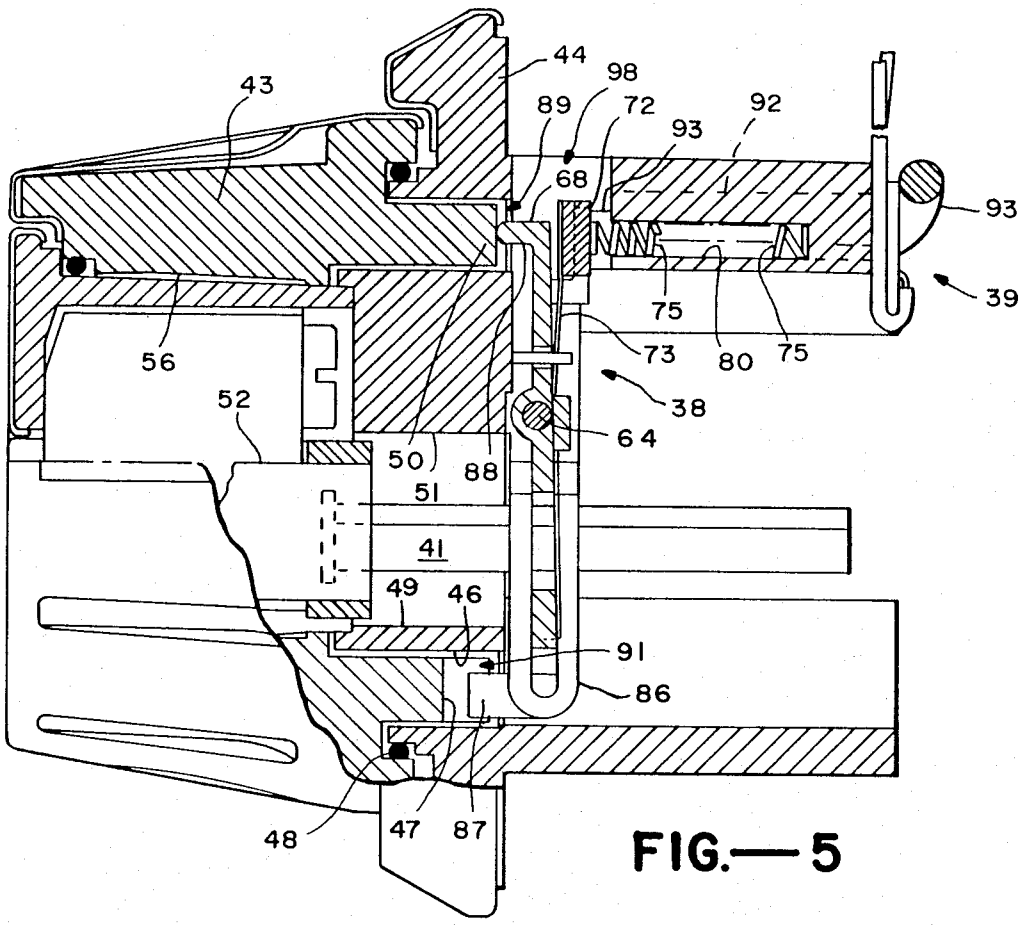
FIG. 5 is a side elevational view corresponding to FIG. 4 showing the assembly in position for coupling of torque from the handle to the drive bar.
Figure 6:
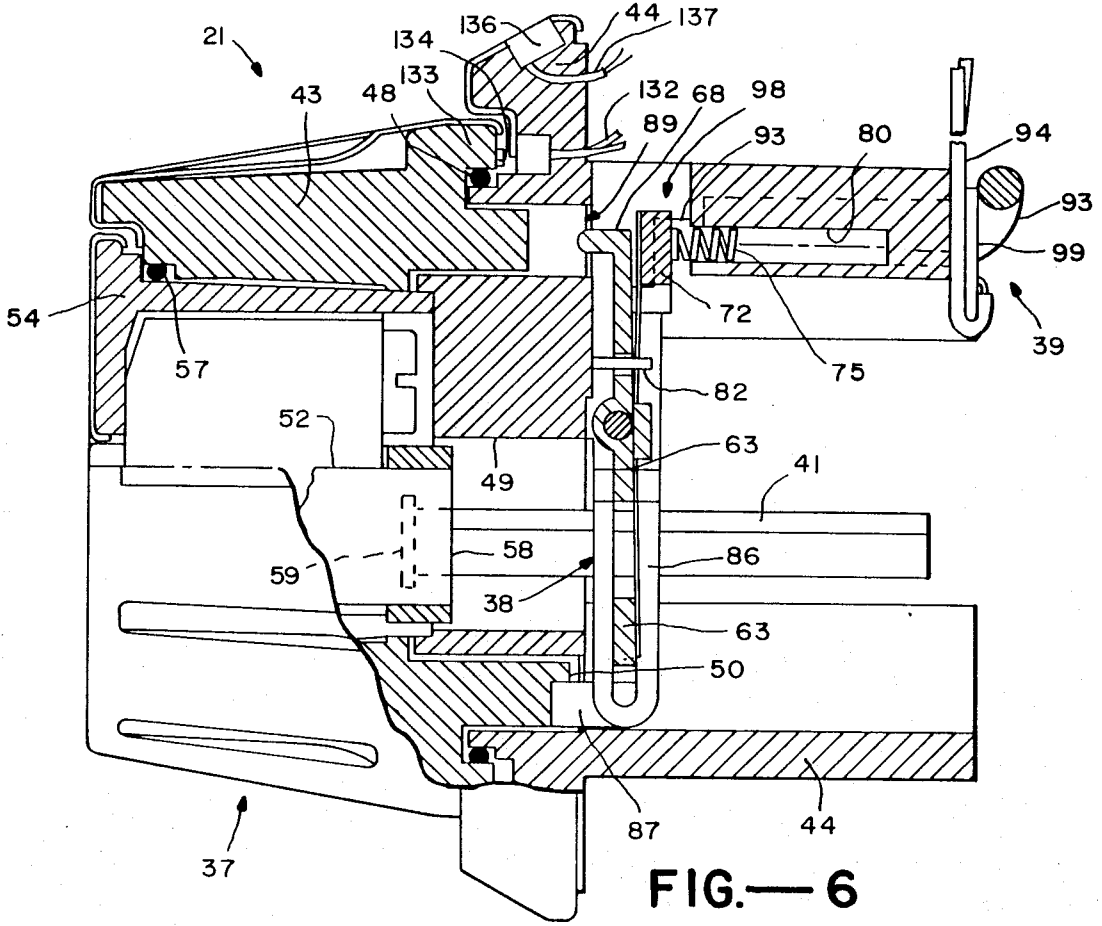
FIG. 6 is a side elevational view corresponding to FIG. 4 showing the handle coupled to the drive bar for displacement of the bolt and showing a modified electromagnet energization switch assembly.

Operation of the dead bolt assembly of the present invention can best be understood by reference to FIGS. 4, 5 and 6.

FIG. 4 illustrates the lock assembly in a state which would be typical of the assembly when electromagnet means 39 is not energized and bolt 34 was in a fully extended position locking the door. If the user grips handle means 37 and rotates the handle, protrusions or lugs 50 on inner surface 47 of the handle member 43 will periodically rotate into engagement with the projection 88 on the upper end of torque transfer assembly 38. Both protrusions 50 and projection 88 preferably are tapered. When protrusions 50 engage projection 88, they will push the rocker arm away or pivot the rocker assembly to the position shown in FIG. 5. This allows lug 50 to pass beyond protrusion 88. It also results in the protrusion 87 on clip 86 at the lower or second end of the rocker assembly to project through opening 91 into groove 46. As may be seen from FIG. 5, however, the inner face 47 is recessed from the end of protrusion 87 at the same time that protrusion 50 engages the projection 88 on the first end of the rocker arm.

When protrusion 50 on handle member 43 passes beyond the protrusion 88 on the rocker arm, spring 75 biases the entire assembly from the position of FIG. 5 back to the position shown in FIG. 4. As the handle is rotated further, the protrusion 50 which engaged the inwardly extending end 88 of the rocker arm now reaches the tab or protrusion 87 on clip 86, as shown at the bottom of FIG. 4. Since spring 75 has returned the rocker assembly to the position of FIG. 4, the lug clears or passes beyond tab 87 without engaging the same.

Without energization of the electromagnet, therefore, handle 37 can be rotated indefininately in either direction with the result that rocker assembly 38 will be pivoted back and forth as the lugs engage and pass beyond the outward projecting end 88 of the rocker arm. In each case, however, the clip tab 87 enters the groove 46 through opening 91, but there is no protrusion present to engage tab 87 at the same time as there is a protrusion present and engaging the projecting end 88 of the rocker arm.

As will be appreciated, a single protrusion 50 on surface 47 of member 43 will always produce the result that only one end of the rocker arm can be engaged at any one time. Similarly, three equidistant protrusions insure that ends 88 and 87 cannot be simultaneously engaged during rotation of handle 37. An even number of protrusions can also be employed as long as they are not spaced at 180 degree intervals or so close to such intervals that spring 75 cannot return the rocker arm with its inertia to the position of FIG. 4 before a protrusion engages tab 87.

Thus, handle 37 can be rotated, even at very high speeds, in either direction without transmitting the torque applied to the handle to bolt 34. Similarly, a pipe wrench or other tool applied to handle 37 cannot be employed to force the dead bolt since handle 37 is uncoupled from drive bar 41.

In order to effect coupling of the handle to the drive bar to permit opening of the lock, electromagnet assembly 39 is energized. When assembly 39 is energized and handle 43 is rotated to a position driving the rocker arm from the position of FIG. 4 to the position of FIG. 5, the air gap between armature 72 and the end of solenoid core 93 is closed. This allows the electromagnet to hold rocker arm assembly 38 in a torque transmitting or coupling position as shown in FIG. 5. When the protrusion 50 passes beyond the outwardly extending end 88 of the rocker arm electromagnet 39 will hold the rocker arm in the torque transmitting position against biasing spring 75. Obviously, the magnetic force generated by electromagnet 39 must be greater than the spring biasing force generated by spring 75 in order to maintain the spring in the position of FIG. 5.

With the torque transmitting assembly held in the torque transmitting position by the electromagnet, handle 43 can be rotated further until projection 50 engages tab 87, which now is positioned through opening 91 into groove 46, as shown at the bottom of FIG. 5. When protrusion 50 reaches tab 87, it will swing or pivot clip 86. Such pivoting will be from the solid line position shown in FIG. 7 to the phantom line position shown in FIG. 7 when extending bolt 34 and rotating the handle in the counterclockwise direction or from the phantom line to the solid line position when retracting the bolt and rotating the handle in the clockwise direction. Thus, protrusion or lug 50 cooperates with clip tab 87 to transmit a torque to the clip and from the clip to drive bar 41 and bolt assembly 42. The drive bar is thereby rotated by approximately 90 degrees, which is sufficient to throw a conventional dead bolt from a fully extended position to a fully retracted position and vice versa. FIG. 6, therefore, illustrates the cooperation of the protrusion 50 with clip tab 87 in pivoting or swinging the clip on the rocker arm 63 so as to transmit torque to drive bar 41.

An important feature of the bolt assembly construction of the present invention is that both the driving of the lock bar and the closing of the air gap in the electromagnet are accomplished by manipulation of handle 37 by the user. Thus, battery power is not used to perform either of these functions. Instead, battery power is employed only to hold or retain the torque transmitting assembly in a position permitting coupling of the handle to the lock driving bar 41.

Figure 7:
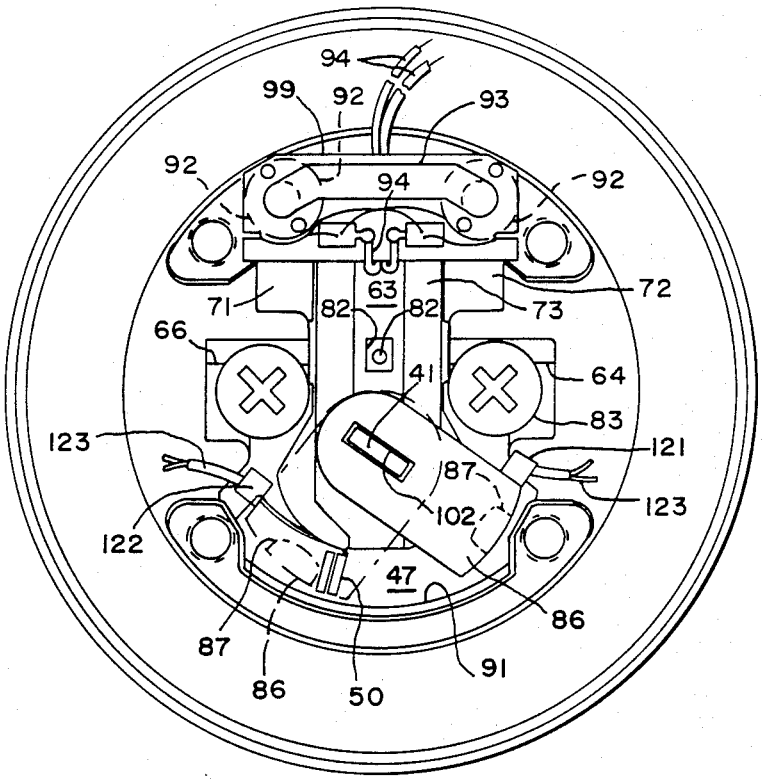
FIG. 7 is an end elevation view of the inwardly facing end of the exterior components of the dead bolt assembly shown in FIG. 4.
Figure 9:
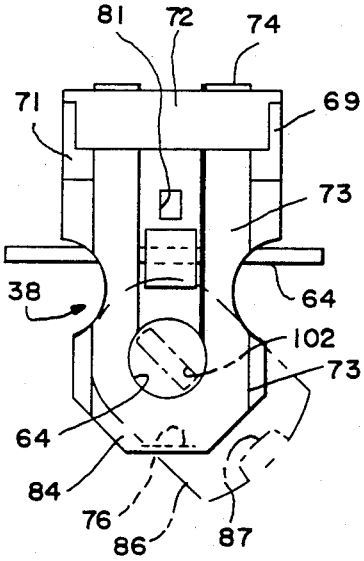
FIG. 9 is an end elevation view of a torque transmitting rocker assembly shown in FIG. 4 with the drive bar clip shown in phantom.
Figure 12:
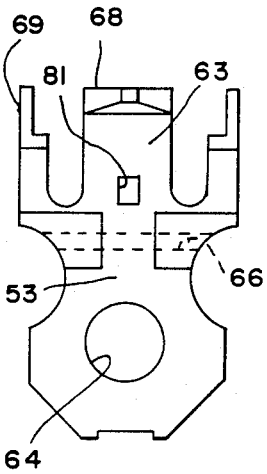
FIG. 12 is an end elevation view of an opposite side of the rocker arm of FIG. 11.

It is further preferable that the lock assembly include limit switch means 121 and 122 (FIG. 7) with associated electrical conductors 123 which are coupled to control board 107 to indicate when the bolt changes the state between the unlocked and the locked positions. As shown in FIG. 7, the limit switches 121 and 122 sense the position of clip 86, although it will be understood that other locations for the limit switches can be employed, e.g., switches mounted proximate thumb turn shaft 104.

Limit switches 121 and 122 can be used to signal the control board that the bolt is fully extended or fully retracted. This signaling can be used to de-energize electromagnet means 39 so as to power down the lock assembly and increase the battery life. If the bolt is extended in the locked position, the user will energize the electromagnet by, for example, inputting a combination to door lock assembly 23. When clip 86 is shifted from one limit switch to the other, the control circuitry knows that the bolt has now been retracted or extended and the control board de-energizes the electromagnet. This de-energization allows the rocker arm to assume the position of FIG. 4, but the bolt is now in the desired position.

The bolt assembly of the present invention advantageously further includes an exit feature which allows locking of the assembly without the use of a combination input. Thus, push button 108 can be used to input control board 107 so as to directly energize electromagnet 39 for a predetermined period in time, for example, sixteen seconds. The user may then exit the door and rotate handle 37 until the rocker arm is positioned in the torque transmitting position of FIG. 5. Since the electromagnet is energized as a result of depressing exit button 108, the rocker arm will be held in the torque transmitting position, and the user can rotate the handle further to transmit torque to the drive bar 41 and extend bolt 34. When bolt 34 is fully extended, the change of position of clip 86 between limit switches 121 and 122 will automatically power down or de-energize electromagnet 39. The user can test the positioning of bolt 34 in the locked position by spinning the handle which should now be free and uncoupled from the torque transmitting assembly 38. This provides a convenient exit mode which requires no coded input to the lock assembly.

Limit switches 121 and 122 also are connected to logic circuitry which will prevent energization of electromagnet 39 when the bolt is in the retracted position if a coded input is given. Coded inputs are used only to unlock the lock, and an exit button 108 input will energize the electromagnet even though the bolt is retracted. This feature further saves battery life.

In order to further aid the user in operation of the lock assembly of the present invention, it is preferable to provide annunciator means 126 in control housing 33 which is coupled to the control board 107 so as to provide an audible signal, such as two tones, when the electromagnet is energized. Thus, when energizing electromagnet 39 by exit button 108 or by an input from any source, annunciator 126 will produce an audible signal consisting of two separated tones. The user can determine, therefore, that the coded entry to the door lock assembly 23 was correct or the push button entry switch 108 was received and that the user can now manipulate handle 37 to open or close the door lock.

It is a further feature of the present invention that the electromagnet be energized for a finite period of time after energization in either the entry or exit mode. Energizing the electromagnet for a finite period of time insures that the user has sufficient time to manipulate the dead bolt assembly in order to open or close the same, and that energization is not prolonged and does not waste power.

In the preferred form of the bolt assembly of the present invention, energization of electromagnet means 39 is accomplished by a coded input to the door lock assembly 23. Upon receipt of the proper coded input, the door lock assembly 23 further transmits a signal 31 to receiver 32 in the dead bolt assembly. The receiver 32, when seeing the proper signal, energizes electromagnet means 39. In this form of the invention, it is most preferable for the transmitter 29 in the electronic door lock assembly 23 to send an encoded signal in the infrared range. Transmitting such signals is well known in the art and can be accomplished by an infrared transmitter 29 which will transmit a digital signal, for example, a 12 bit signal with four synchronization zeros followed by eight data bits. The infrared signal can be transmitted using pulse width modulation techniques at the rate of 1,024 bits per second, and the signal sequence may be transmitted a minimum of 85 times during a one second transmission time. The use of an encoded signal 31 insures that spurious infrared signals, for example, from light sources or transmitters conventionally found in the home or office, will not inadvertently energize the dead bolt assembly.

As will be appreciated, other forms of a signal 31 can be used to couple the dead bolt assembly 21 to the coded input to electronic lock assembly 23. Thus, visible light signals, radio frequency signals, hard wired electrical signals and audible signals are all suitable for use in coupling the two lock assemblies together.

It also is an important feature of the present invention to be able to use the dead bolt assembly 21 as a stand-alone lock assembly. Thus, FIG. 6 illustrates a modified form of bolt assembly 21 in which switch means 131 with associated conductors 132 has been added to lock body 44 proximate a movable annular portion 133 on handle member 43. The movable portion or ring 133 can be provided with means 134 which cooperates with switch 131 to open and close the switch in a manner permitting a coded input to control board 107. Mounted in a position visible to the user can be a L.E.D. indicator 136, which also is coupled by conductors 137 to control board 107 so as to indicate the code being input by the user.

Numerous switch logic systems are suitable for inputting code to control board 107 through manual manipulation of handle 37. The means 134 on the handle can cooperate mechanically or magnetically with the switch means and can include an array which will allow zeroing of the input and counting up or down to a desired number. Such digital input switches are well known in the art and not regarded per se as being a novel portion of the dead bolt assembly of the present invention.

Dead bolts differ from door latch assemblies in that the slot 105 which receives drive bolt 41 is off-center to enable the lever assembly to block return of the bolt. One cannot merely turn the bolt over for right or left-hand installations; the bolt is swung about a vertical axis to maintain slot 105 in a below-center position. Since dead bolts must be capable of mounting in either right-handed or left-handed installations, the assembly of the present invention further preferably includes a logic circuit which cooperates with limit switches 121 and 122 and battery 96 to initialize the assembly for a right or a left-handed installation. In a right-handed installation one limit switch is contacted, while in a left-handed installation the opposite switch is contacted by clip 86 when the bolt is in a retracted position. The user, therefore, first fully retracts bolt 34. Next, the user inserts battery 96 into the electrical circuit. Insertion of the battery with the bolt retracted causes the logic circuitry to "see" which one of switches 121 and 122 is contacted and therefore to sense the open (retracted) position of the lock for the right or left-handed installation.

It is further desirable that the electronic circuitry be powered by a nine volt alkaline battery. When the bolt assembly is not energized, the only current drawn is the minimal current (less than one milliamp) required for the photo transistor receiver 32 to look for a signal 31 from infrared emitter 29. Assuming an average of 5 exit (lock) and 0.5 entry (unlock) operations per day with an average energization time of the electromagnet of 8 seconds to lock and 4 seconds to unlock, battery life will be between one and two years. The control circuitry further preferably includes a low voltage signal, for example, eight spaced apart audible tones, when exit button 108 is pressed and battery voltage is low (e.g., 6.0 volts).

It also should be noted that most of the components of dead bolt assembly 21 and door lock assembly 23 are formed of non-ferromagnetic parts. More particularly those components proximate the solenoids (except the armatures) are most preferably formed of plastic or non-ferromagnetic metals.

While the lock assembly of U.S. Pat. No. 4,457,148 is suitable for use as assembly 23 it is most preferable to employ a lock assembly constructed as set forth in detail in the commonly owned and contemporaneously filed patent application of Thomas E. Corder and James B. Mullin entitled Battery-Powered Door Lock Assembly And Method.

What is claimed:

1. A method of operating a bolt assembly having a movable exterior handle means, movable bolt means, movable transfer means transmitting motion of said handle means to move said bolt means, and electromagnet means responsive to user input for energization of the same, said method including the steps of:

biasing said transfer means to a position in which motion of said handle cannot be transmitted to said bolt means;

moving said transfer means by said handle means against said biasing means to a motion transmitting position;

energizing said electromagnet means by user input to hold said transfer means against said biasing means in said motion transmitting position; and moving said handle means while said transfer means is held in said motion transmitting position until said transfer means is moved by said handle means to produce movement of said bolt means.

2. In a bolt assembly including movable bolt means, and a user manipulatable bolt displacement assembly for displacement of said bolt means between a locked position and an unlocked position, the improvement in said bolt assembly comprising:

said displacement assembly including:

(i) a user manipulatable handle means on an exterior side of said bolt assembly mounted for rotation without coupling of said handle means to displace said bolt means;

(ii) torque transfer means mounted for movement to and from a torque transmitting position in response to movement of said handle means, said torque transfer means includes rocker assembly mounted for movement into and out of said torque transmitting position in response to engagement with said handle means during rotation thereof;

(iii) said displacement assembly further including a bolt driver bar connected to displace said bolt means; and (iv) electromagnet means having input means for engergization thereof and positioned to magnetically hold said torque transfer means in said torque transmitting position upon the occurrence of energization of said electromagnet means and upon movement of said torque transfer means to said torque transmitting position;

said torque transfer means further carries a movable clip means coupled to said driver bar and having a tab portion engageable by said handle means only when said rocker assembly is held in said torque transmitting position to transmit motion from said handle means to said driver bar and thereafter to said bolt means; and said handle means being further rotatable by the user while said torque transfer means is in said torque transmitting position to couple said handle means to said bolt means for the transmission of torque from said handle means to move said bolt means between said locked position and said unlocked position.

3. The bolt assembly as defined in claim 2 wherein, said rocker assembly is mounted for pivotal movement about a pivotal axis intermediate opposed ends of said rocker assembly, said pivotal axis being oriented substantially perpendicular to the axis of rotation of said handle means;

said rocker assembly engages said handle means proximate a first end thereof and carries said clip means proximate an opposite second end thereof; and said first end of said rocker assembly is biased into engagement with said handle means.

4. The bolt assembly as defined in claim 3 wherein, said electromagnet means includes a solenoid and an armature; and one of said solenoid and said armature is carried by said rocker assembly for movement therewith, and a remainder of said solenoid and said armature is fixedly mounted proximate said rocker assembly.

5. The bolt assembly as defined in claim 4 wherein, said armature is mounted to said first end of said rocker assembly;

said rocker assembly is biased to position said armature in spaced relation to said solenoid; and said handle means is comprised of a ring member having at least one protrusion on an inner end surface thereof facing said rocker assembly, said protrusion having a height dimension cooperating with said rocker assembly sufficient to displace said rocker assembly about said pivotal axis until said armature engages said solenoid.

6. The bolt assembly as defined in claim 5 wherein, said clip means includes a tab extending in the direction of said ring member; and said tab on said clip means is formed to cooperatively engage said protrusion on said ring member when said rocker assembly is held in said torque transmitting position by said electromagnet means.

7. The bolt assembly as defined in claim 2 wherein, said bolt means is mounted for movement between said locked position and said unlocked position without the action of a spring to provide a dead bolt assembly;

said handle means is comprised of a ring rotatably mounted about an axis of rotation in a plane substantially perpendicular to the direction of movement of said bolt means, said ring having an inner annular end face with at least one lug extending inwardly from said face;

said rocker assembly is mounted for pivotal movement about a pivotal axis intermediate a first end and a second end of said rocker assembly, said pivotal axis being oriented in a plane substantially perpendicular to said axis of rotation of said ring, said first end of said rocker assembly including a portion for engagement by said lug and said first end carrying an armature of said electromagnet means, said second end having a portion for engagement by said lug and carrying said clip means connected to drive said bolt means biasing said first end of said rocker assembly toward said ring; and said electromagnet means including a solenoid fixedly mounted proximate said first end and said solenoid generating a magnetic force sufficient to overcome the force biasing said rocker assembly toward said ring when said armature is substantially in contact with said solenoid.

8. The bolt assembly as defined in claim 7 wherein, said portion on said first end and said portion on said clip means each protrude toward said ring.

9. The bolt assembly as defined in claim 7 wherein, said clip means is pivotally mounted to said second end of said rocker assembly for pivotal movement about an axis parallel to said axis of rotation of said ring in order to apply a rotational force to drive said bolt means between said locked position and said unlocked position.

10. The bolt assembly as defined in claim 9 wherein, said clip means is provided as a U-shaped clip having opposed legs formed with aligned slots therein;

said displacement assembly includes a driver bar coupled to move said bolt means;

said rocker assembly has an opening in said second end dimensioned to rotationally receive said driver bar; and said clip is mounted on said second end with said legs on opposite sides of said second end, said slots aligned with said opening, and said driver bar mounted through said slots and said opening.

11. The bolt assembly as defined in claim 7 wherein, said end face of said ring is provided with three circumferentially spaced apart inwardly extending lugs.

12. In a bolt assembly including movable bolt means, and a user manipulatable bolt displacement assembly for displacement of said bolt means between a locked position and an unlocked position, the improvement in said bolt assembly comprising:

said displacement assembly including:

(i) a user manipulatable movable handle means;

(ii) transfer means mounted for movement between a position to transmit motion coupling said handle means to move said bolt means and a position releasing said handle means for movement which is incapable of transmitting motion to said bolt means;

(iii) biasing means urging said transfer means to said position releasing said handle means, said handle means and said transfer means further being cooperatively formed to move said transfer means against said biasing means to said position to transmit motion in response to motion of said handle means; and (iv) electromagnet means having input means for energization thereof and positioned to magnetically hold said transfer means against said biasing means in said position to transmit motion upon the occurrence of energization of said electromagnet means and upon movement of said transfer means by said handle means; and said handle means being further movable by the user while said transfer means is held in said position to transmit motion by said electromagnet means for the transmission of motion from said handle means to said bolt means to move said bolt means from said locked position to said unlocked position.

13. The bolt assembly as defined in claim 12 wherein, said electromagnet means includes an armature and a solenoid, with one of said armature and said solenoid carried by said transfer means for movement therewith and a remainder thereof mounted proximate said transfer means; and at least one of said armature and solenoid being mounted to provide over-travel in insure positive contact of said armature and solenoid.

14. The bolt assembly as defined in claim 13 wherein, said armature is mounted to said torque transfer means, said solenoid is mounted to a support member proximate said torque transfer means, and said armature is mounted by mounting means permitting relative movement of said armature with respect to said mounting means upon initial contact of said armature with said solenoid, said mounting means further resiliently biasing said armature toward contact with said solenoid.

15. The bolt assembly as defined in claim 12, and a door lock assembly mounted proximate said molt assembly, said door lock assembly including user input means responsive to user input to effect unlocking of said door lock assembly and responsive to user input to generate an output signal; and said bolt assembly responsive to said output signal from said door lock assembly to energize said electromagnet means.

16. The bolt assembly as defined in claim 15 wherein, said door lock assembly includes signal transmitter means, said bolt assembly includes signal receiver means mounted to receive signals from said transmitter means to energize said electromagnet means.

17. The bolt assembly as defined in claim 15 wherein, said door lock assembly includes means responsive to a coded user input coupled to transmitter means to produce said output signal in response to said coded input; and said bolt assembly includes receiver means mounted to receive said output signal from said transmitter means and energize said electromagnet means in response thereto.

18. The bolt assembly as defined in claim 12 wherein, said electromagnet means includes user input means on an interior side of said assembly responsive to user input to energize said electromagnet means for a predetermined time period.

19. The bolt assembly as defined in claim 12 wherein, said electromagnet means includes switch means responsive to a change of position of said bolt means to de-energize said electromagnet means.

20. In a bolt assembly including a movable bolt, a movable handle, motion transfer means mounted for movement between a coupled position and an uncoupled position, said motion transfer means coupling said handle for movement of said bolt in said coupled position and said motion transfer means uncoupling said handle from said bolt in said uncoupled position, and electromagnet means responsive to user input for energizing thereof and positioned to hold said motion transfer means in said coupled position when energized, the improvement in said bolt assembly comprising:

said motion transfer means being normally biased to said uncoupled position, said handle and said motion transfer means being cooperatively formed for displacement of said motion transfer means to said coupled position against biasing thereof by movement of said handle, and said electromagnet means having sufficient force to hold said motion transfer means in said coupled position against biasing thereof for movement of said bolt upon movement of said motion transfer means by said handle.

21. The bolt assembly as defined in claim 20 wherein, said motion transfer means being biased and said handle and said motion transfer means being cooperatively formed to free said handle for movement which is incapable of transmitting motion to said bolt except upon energizing of said electromagnet.

22. The dead bolt assembly as defined in claim 20 wherein, said assembly includes mechanical key-driven tumbler assembly coupled to displace said bolt means independently of said motion transfer means.

23. In a bolt assembly including movable bolt means, and a user manipulatable bolt displacement assembly for displacement of said bolt means between a locked position and an unlocked position, the improvement in said bolt assembly comprising:

said displacement assembly including:

(i) a user manipulatable handle means rotatably mounted for rotation through 360 degrees;

(ii) torque transfer means mounted for movement to and from a torque transmitting position in response to rotation of said handle means;

(iii) biasing means biasing said torque transfer means out said torque transmitting position;

(iv) electromagnet means having input means for energization thereof and positioned to magnetically hold said torque transfer means against said biasing means in said torque transmitting position upon the occurrence of energization of said electromagnet means and upon movement of said torque transfer means to said torque transmitting position by said handle means;

said handle means being further movable by the user while said torque transfer means is held in said torque transmitting position by said electromagnet means for the transmission of torque form said handle means through said torque transfer means to move said bolt means from said locked position to said unlocked position; and said handle means, said torque transfer means and said biasing means being cooperatively formed to prevent transmission of torque from said handle means to said bolt means except when said electromagnet means is energized.

* * * * *